US011697189B2

(12) United States Patent
Chartier et al.

(10) Patent No.: US 11,697,189 B2
(45) Date of Patent: Jul. 11, 2023

(54) CLAMPING SYSTEMS FOR PIPES

(71) Applicant: Ridge Tool Company, Elyria, OH (US)

(72) Inventors: Glen R. Chartier, Avon Lake, OH (US); Scott Kruepke, Valley City, OH (US); Lawrence Feskanich, Jr., Olmsted Township, OH (US); Katherine Hall, North Ridgeville, OH (US); Don Embree, Akron, OH (US); Seth Bullock, Cleveland, OH (US); Robert Skrjanc, Lorain, OH (US)

(73) Assignee: Ridge Tool Company, Elyria, OH (US)

( * ) Notice: Subject to any disclaimer, the term of this patent is extended or adjusted under 35 U.S.C. 154(b) by 610 days.

(21) Appl. No.: 16/591,753

(22) Filed: Oct. 3, 2019

(65) Prior Publication Data

US 2020/0108487 A1 Apr. 9, 2020

Related U.S. Application Data

(60) Provisional application No. 62/741,588, filed on Oct. 5, 2018.

(51) Int. Cl.
*B25B 5/10* (2006.01)
*B25B 5/04* (2006.01)

(52) U.S. Cl.
CPC ..... *B25B 5/106* (2013.01); *B25B 5/04* (2013.01)

(58) Field of Classification Search
CPC .. B25B 3/00; B25B 5/00; B25B 5/067; B25B 5/101; B25B 5/106; B25B 5/04
USPC ..... 29/559, 235, 255, 278, 27, 243.55; 269/289 mr
See application file for complete search history.

(56) References Cited

U.S. PATENT DOCUMENTS

| | | | | |
|---|---|---|---|---|
| 1,505,205 | A | 8/1924 | Kilgour, Jr. | |
| 4,625,464 | A * | 12/1986 | Kubo | B27B 33/20 30/92 |
| 5,933,963 | A | 8/1999 | Pierce | |
| 7,114,234 | B2 * | 10/2006 | Penman | E21B 19/168 29/464 |
| 7,257,895 | B2 | 8/2007 | Makkonen et al. | |
| 8,357,872 | B2 | 1/2013 | Lier | |
| 2003/0093904 | A1 | 5/2003 | Makkonen | |

(Continued)

FOREIGN PATENT DOCUMENTS

| | | | |
|---|---|---|---|
| CN | 201316874 | Y | 9/2009 |
| CN | 205465299 | U * | 8/2016 |

(Continued)

OTHER PUBLICATIONS

CN-205764673—Machine Translation (Year: 2016).*

(Continued)

*Primary Examiner* — Lee D Wilson
*Assistant Examiner* — Alberto Saenz
(74) *Attorney, Agent, or Firm* — Mark E. Bandy; Rankin Hill & Clark, LLP

(57) ABSTRACT

Systems for cutting cylindrical workpieces such as pipe are described. The systems include a clamping assembly and can be used in various methods. In one method, the clamping assembly and a cutting tool or saw is used on a rotating workpiece. In another method, the clamping assembly and a cutting tool or saw is used on a stationary workpiece. Also described are frames that can be secured to the clamping assembly.

23 Claims, 14 Drawing Sheets

(56) References Cited

U.S. PATENT DOCUMENTS

| | | | | |
|---|---|---|---|---|
| 2013/0269500 | A1 | 10/2013 | Makkonen et al. | |
| 2014/0150266 | A1 | 6/2014 | Priha et al. | |
| 2015/0202699 | A1* | 7/2015 | Makkonen | B23D 45/126 30/92 |
| 2017/0197296 | A1* | 7/2017 | Isusi | B25B 1/06 |

FOREIGN PATENT DOCUMENTS

| | | | | |
|---|---|---|---|---|
| CN | 205465299 | U | | 8/2016 |
| CN | 105947086 | A | | 9/2016 |
| CN | 205764673 | U | * | 12/2016 |
| CN | 205764673 | U | | 12/2016 |
| CN | 106457529 | A | | 2/2017 |
| CN | 106975786 | A | | 7/2017 |
| DE | 2937751 | C2 | | 11/1982 |
| DE | 3521697 | A1 | | 2/1986 |
| DE | 102014109150 | A1 | | 12/2015 |
| DE | 112014003631 | T5 | | 4/2016 |
| EP | 1301311 | | | 9/2005 |
| EP | 1628797 | | | 7/2010 |
| EP | 2907609 | | | 8/2015 |
| EP | 2729272 | | | 12/2015 |
| EP | 3313601 | A1 | | 5/2018 |
| FI | 118076 | | | 6/2007 |
| WO | WO2002002271 | | | 1/2002 |
| WO | WO2004103623 | | | 12/2004 |
| WO | WO 2012045912 | | | 4/2012 |
| WO | WO2013004918 | | | 1/2013 |
| WO | WO2016207489 | A1 | | 12/2016 |

OTHER PUBLICATIONS

CN-205465299—Machine Translation (Year: 2016).*

Chinese Office Action and Search Report; dated Feb. 19, 2021; Application CN 201910949143X (10 pages).

Office Action English translation (10 pages).

Search Report English Translation (2 pages).

Examination Report dated Mar. 10, 2022; Application No. 10 2019 215 325.9; 12 pages.

* cited by examiner

CLAMPING SYSTEMS FOR PIPES

CROSS REFERENCES TO RELATED APPLICATIONS

This application claims priority from U.S. provisional application Ser. No. 62/741,588 filed on Oct. 5, 2018.

FIELD

The present subject matter relates to steel pipe fabrication and cutting, but could be extended to fabrication or processing of other tubular materials. Further, the present subject matter could be used in applications in which movement around a cylindrical object is required.

BACKGROUND

A need exists for a very efficient and accurate way to cut steel pipe of various sizes on a job site. Commonly used methods such as plasma cutting or torch cutting require significant setup time and result in a cutting surface that requires additional operations, for example grinding. In addition, many applications involve "on the ground cutting," with the pipe supported by rollers, or "in-place cutting," with the pipe being either fixed on a pipe stand or already installed.

In some applications, workplace environments do not allow open flame/torch presence to accomplish workpiece cutting. Accordingly, a need exists for separation of pipe sections without the use of a flame and a strategy to complete the cutting action faster than current practices, resulting in increased productivity and output. Providing an accurate cut allows secondary fabrication processes, for example beveling, to be applied directly following the cut, thereby eliminating the need to refine the cut end prior to those processes being applied to the workpiece.

In addition, a need exists for a tool that can be used on a rotating pipe or workpiece, but with greater flexibility by also allowing rotation around a stationary workpiece. This ability to adapt to either method of cutting would be significant and would provide greater efficiency in processing pipe in a workshop or on a jobsite.

SUMMARY

The difficulties and drawbacks associated with previous approaches are addressed in the present subject matter as follows.

In one aspect, the present subject matter provides a clamping system comprising a base defining a threaded member and a pair of arms pivotally supported by the base. Each arm defines a proximal end and an opposite distal end. The clamping system also comprises a shaft threadedly engaged with the threaded member of the base. The shaft defines a proximal end and an opposite distal end. The clamping system also comprises a central carriage rotatably affixed to the distal end of the shaft and slideably retained to the pair of arms. Rotation of the shaft relative to the base results in (i) axial displacement of the shaft and linear displacement of the central carriage, and (ii) pivotal displacement of the pair of arms.

In another aspect, the present subject matter provides a clamping system comprising a base defining a threaded member, a pair of arms pivotally supported by the base, each arm defining a proximal end and an opposite distal end, a shaft threadedly engaged with the threaded member of the base, the shaft defining a proximal end and an opposite distal end, and a central carriage rotatably affixed to the distal end of the shaft and slideably retained to the pair of arms. Rotation of the shaft relative to the base results in (i) axial displacement of the shaft and linear displacement of the central carriage, and (ii) pivotal displacement of the pair of arms. Each arm also defines a guide slot extending at least partially between the proximal end and the distal end of the arm. The clamping system further comprises a first locating pin extending from the central carriage through the guide slot of a first arm of the pair of arms and a second locating pin extending from the central carriage through the guide slot of a second arm of the pair of arms to thereby movably retain the central carriage to the pair of arms. Each arm of the pair of arms includes one or more rollers. And, the central carriage includes one or more rollers rotatably secured to the central carriage.

In another aspect, the present subject matter provides a method of engaging a tool to a cylindrical workpiece. The method comprises providing a clamping system including (i) a base defining a threaded member, (ii) a pair of arms pivotally supported by the base, each arm defining a proximal end and an opposite distal end, wherein the pair of arms include one or more rollers, each roller rotatably secured at the distal end of an arm of the pair of arms, (iii) a shaft threadedly engaged with the threaded member of the base, the shaft defining a proximal end and an opposite distal end, and (iv) a central carriage rotatably affixed to the distal end of the shaft and slideably retained to the pair of arms, wherein the central carriage includes one or more rollers rotatably secured to the central carriage, wherein rotation of the shaft relative to the base results in axial displacement of the shaft and linear displacement of the central carriage, and pivotal displacement of the pair of arms. The method also comprises positioning the clamping system onto the cylindrical workpiece. The method additionally comprises rotating the shaft relative to the base until (i) the one or more rollers of the pair of arms, and (ii) the one or more rollers secured to the central carriage, contacts the cylindrical workpiece. And, the method comprises securing the tool to the workpiece.

As will be realized, the subject matter described herein is capable of other and different embodiments and its several details are capable of modifications in various respects, all without departing from the claimed subject matter. Accordingly, the drawings and description are to be regarded as illustrative and not restrictive.

DETAILED DESCRIPTION OF THE EMBODIMENTS

In one embodiment, the present subject matter provides a clamping system particularly adapted for use with cylindrical or tubular workpieces such as pipe. This embodiment of the clamping system comprises two pivoting arms, a base, a central carriage, a threaded shaft, and an optional handle. This assembly forms a clamping system and can be used to adapt a cutting blade or other tool to engage a workpiece and particularly a cylindrical workpiece such as a pipe. The pivoting arms and the central carriage typically include rollers or wheels that contact a workpiece such as a cylindrical pipe to provide three (3) or more points of contact and allow rotation of a cutting tool engaged to the clamping system about the axis of the workpiece. The end of the threaded shaft is fixed to the central carriage but threaded through the base and handle assembly. The pivoting arms utilize guide slots for respective locating pins to pass through and control the position of the pivoting arms when the distance between the central carriage and base and handle assembly is changed.

To attach the clamping system to a pipe or workpiece, the threaded shaft is rotated in a direction that correlates with a reduction in distance between (i) the base and the handle assembly and (ii) the central carriage. With this movement, the fixed pivot point(s) of the pivoting arms on the base and handle assembly, and the guide slot profile of the arms force the rollers at the ends of the arms to spread apart and move downward, away from the roller on the central carriage. When the opening between the pivoting arms is adequate to install the clamping system onto the pipe or workpiece, the assembly is placed into position and the threaded shaft rotated to increase the distance between the base and handle assembly, and the central carriage, thereby drawing the rollers inward, toward the axis of the workpiece. Further tightening will properly constrain the assembly to the workpiece and allow movement of the assembly around the circumference of the pipe or workpiece with either the pipe stationary and the assembly moving around, or with the pipe rotated and the assembly held in position (or varying combinations thereof).

Figure 1:
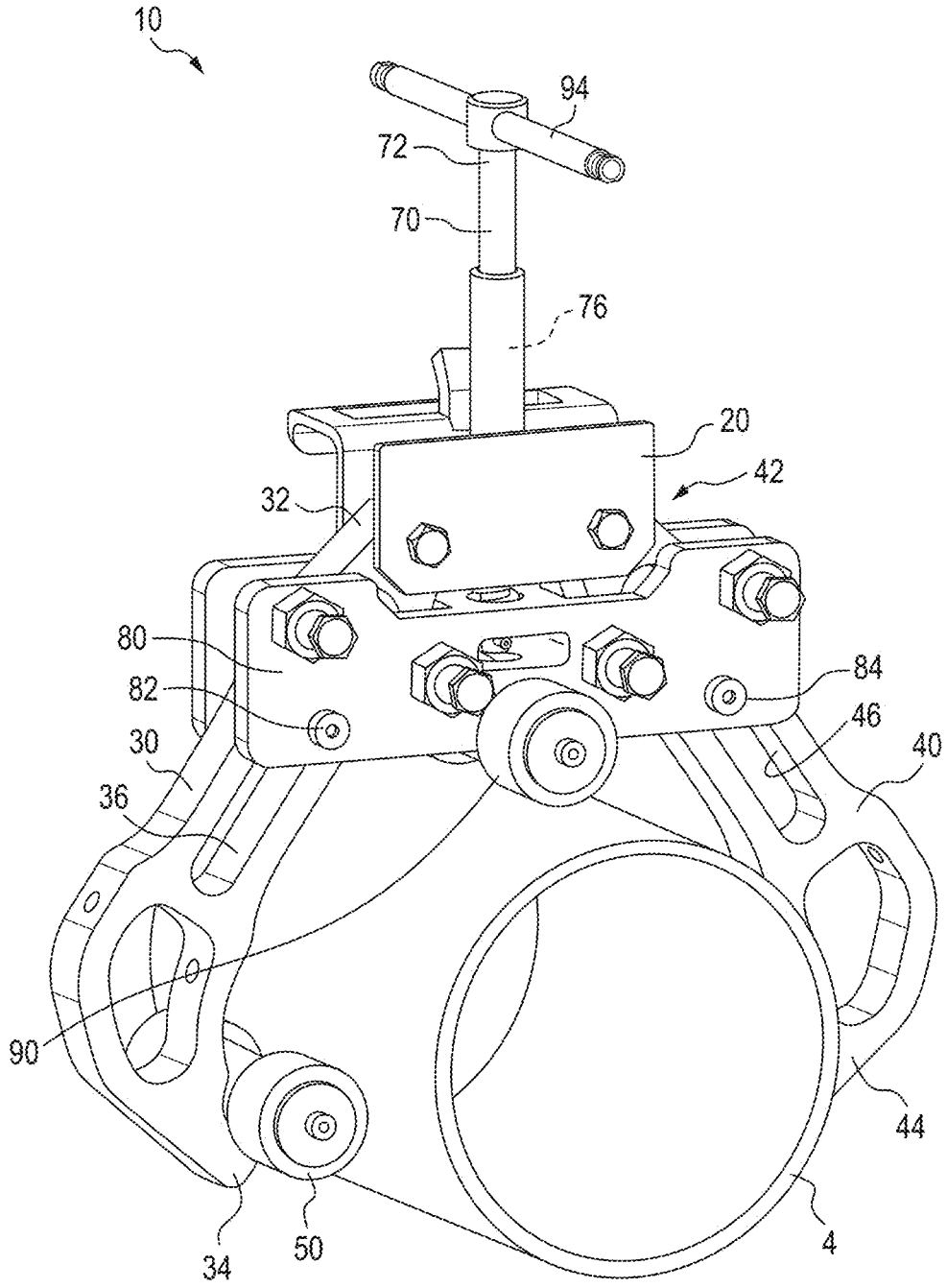
FIG. 1 is a perspective schematic view of an embodiment of a clamping system in accordance with the present subject matter.
Figure 2A:
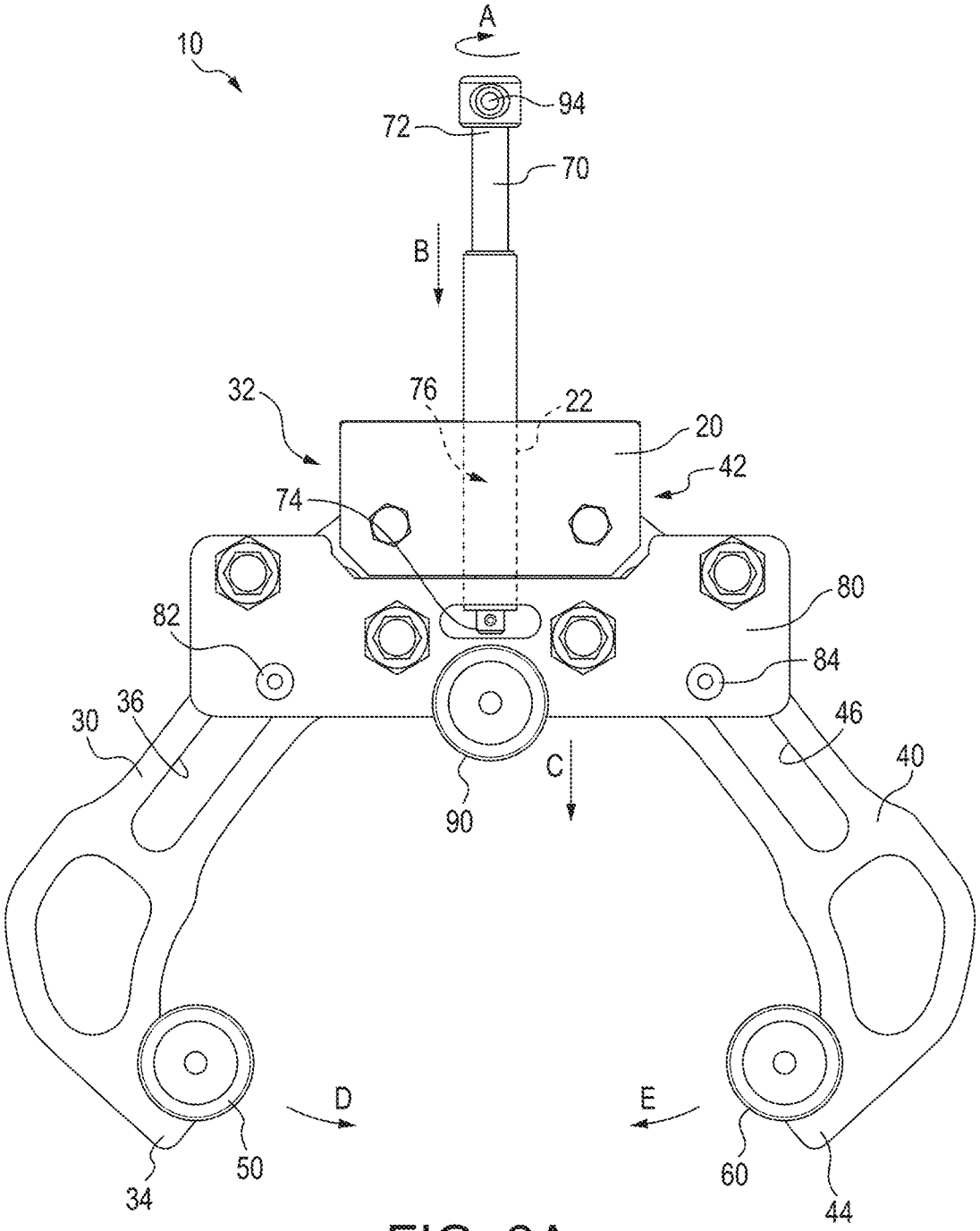
FIGS. 2A and 2B illustrate the clamping system of FIG. 1 in a fully open position and a fully closed position, respectively.
Figure 2B:
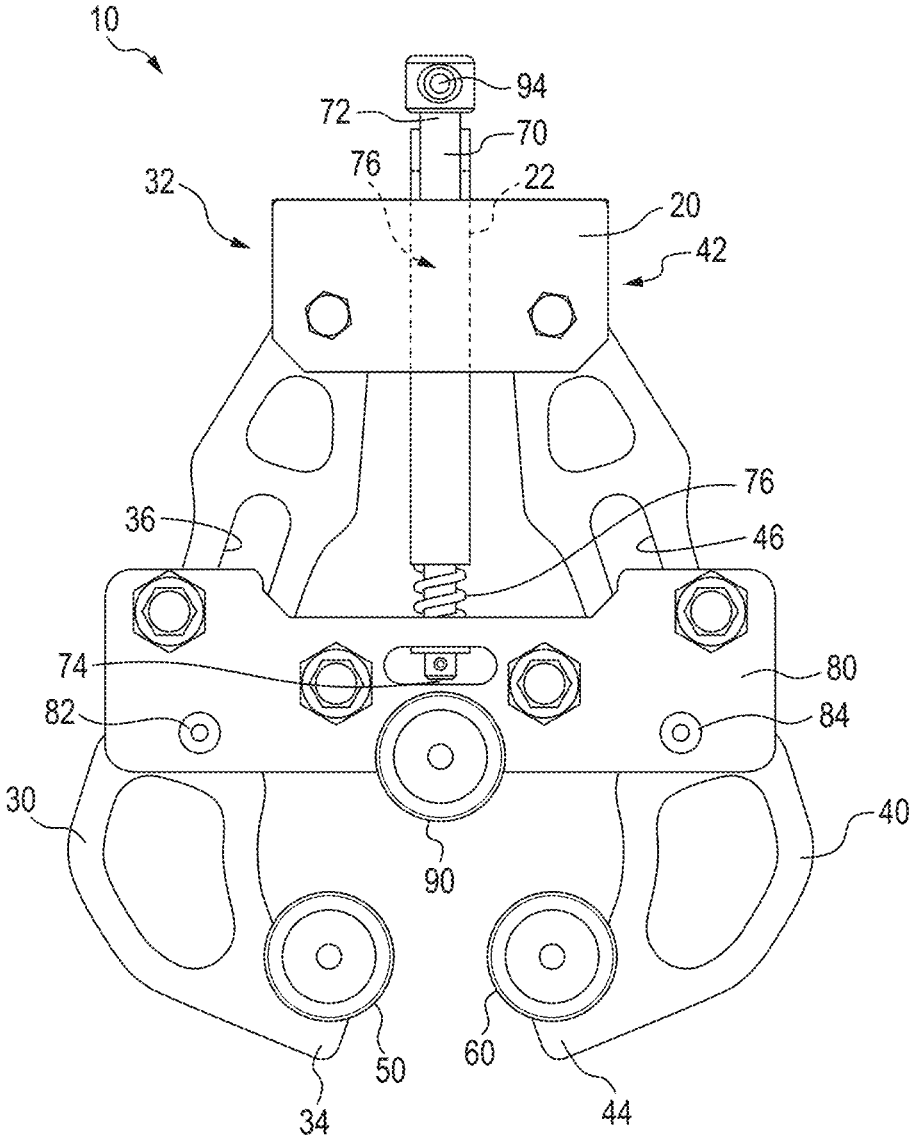
Figure 12:
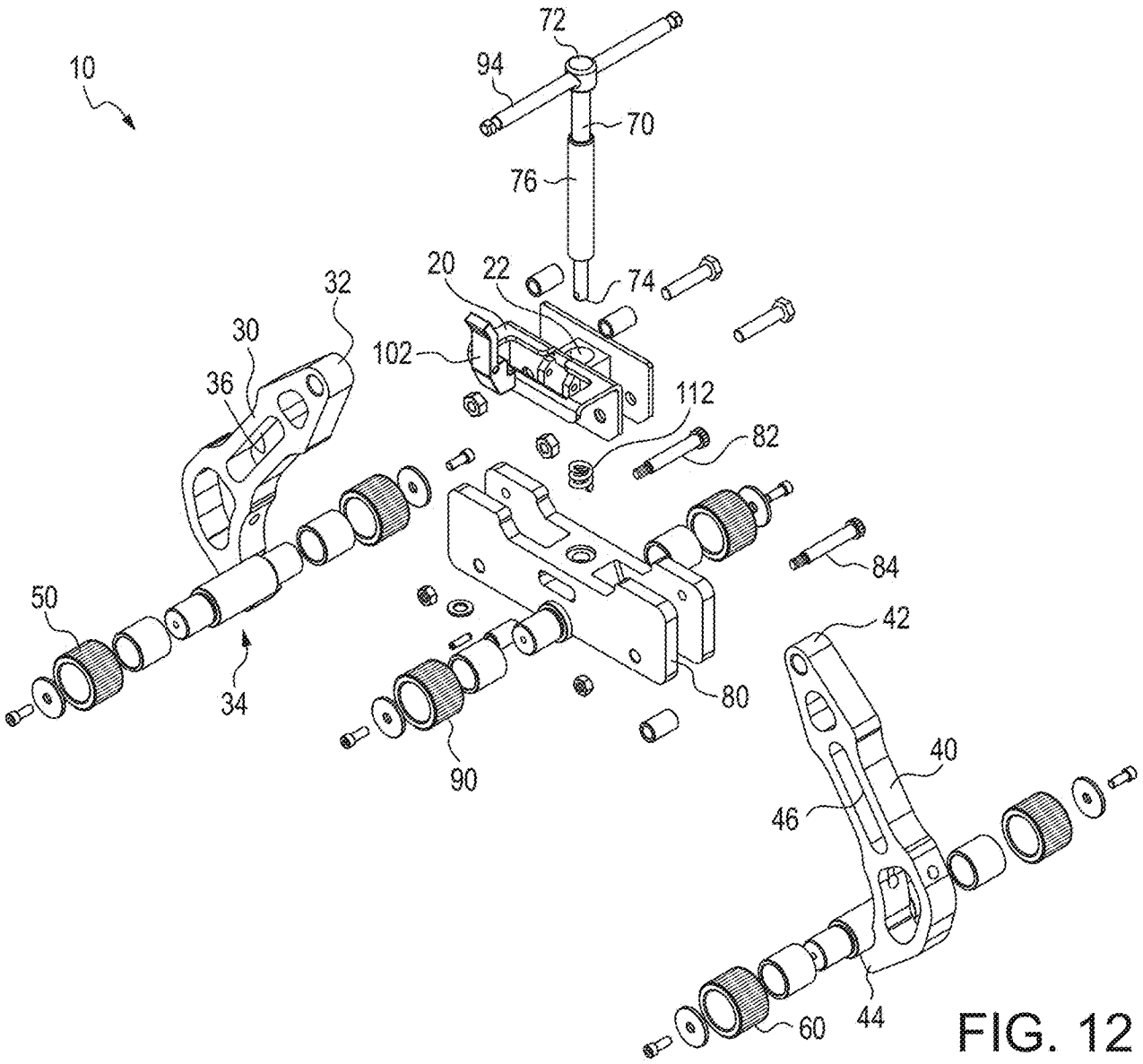
FIG. 12 is an exploded assembly view of the clamping system of FIG. 1 illustrating additional features and aspects.

FIGS. 1, 2A, 2B, and 12 illustrate a preferred embodiment of a clamping system 10 in accordance with the present subject matter. FIG. 1 shows the clamping system 10 engaged about the periphery of a cylindrical workpiece 4. FIGS. 2A and 2B illustrate the clamping system 10 in a fully open position and a fully closed position, respectively, without depicting the workpiece. FIG. 12 is an exploded assembly view of the clamping system 10. Specifically, the clamping system 10 comprises a base 20 having a threaded member or region 22. Typically, the threaded region 22 is in the form of a female bore or aperture having helical thread(s). The clamping system 10 also comprises a pair of arms including a first arm 30 defining a proximal end 32 and an opposite distal end 34. The first arm 30 also defines a guide slot 36 extending at least partially between the ends 32 and 34. The pair of arms also includes a second arm 40 defining a proximal end 42 and an opposite distal end 44. The second arm also defines a guide slot 46 extending at least partially between the ends 42 and 44. In many versions, rollers are provided at or near the distal ends of the arms. For example, a first roller 50 is provided at the distal end 34 of the first arm 30, and a second roller 60 is provided at the distal end 44 of the second arm 40. Each arm can utilize a plurality of rollers. The first and second arms 30, 40 are pivotally supported and secured to the base 20. The clamping system 10 also comprises a shaft 70 defining a proximal end 72 and an opposite distal end 74. The shaft 70 also defines a threaded region 76. The shaft 70 is threadedly engaged with the base 20 via the threaded region 22 of the base. The clamping system 10 also comprises a central carriage 80. The central carriage 80 includes a central roller 90 or plurality of rollers rotatably secured thereto. The central carriage 80 is rotatably affixed to the distal end 74 of the shaft 70 such that the shaft 70 can undergo rotation without transfer of such rotation to the central carriage 80. The central carriage 80 is movably retained to the pair of arms, i.e., the first arm 30 and the second arm 40 as described herein. The clamping system 10 is configured such that rotation of the shaft 70 relative to the base 20 results in (i) axial displacement of the shaft 70 and linear displacement of the central carriage 80, and (ii) pivotal displacement of the arms 30, 40. For example, referring to FIGS. 2A and 2B, rotating the shaft 70 in the direction of arrow A results in axial displacement of the shaft 70 relative to the base 20 in the direction of arrow B, and linear displacement of the central carriage 80 relative to the base 20 in the direction of arrow C. Concurrently, the noted rotation of the shaft 70 in the direction of arrow A also results in pivotal displacement of the arms 30, 40 toward each other, i.e., the first arm 30 moves in the direction of arrow D, and the second arm 40 moves in the direction of arrow E.

In certain versions of the clamping system 10, the central carriage 80 is movably retained to the pair of arms by locating pins such as locating pins 82 and 84 shown in the referenced figures. Specifically, the clamping system 10 further comprises a first locating pin 82 extending from the central carriage 80 through the guide slot 36 of the first arm 30, and a second locating pin 84 extending from the central carriage 80 through the guide slot 46 of the second arm 40. As will be understood by reference to FIGS. 2A and 2B, as the clamping system 10 is positioned from an open position (FIG. 2A) toward a closed position (FIG. 2B), the locating pins 82 and 84 are urged within their respective guide slots 36, 46 toward a distal end 34, 44 of a corresponding arm 30, 40.

In certain embodiments, the clamping system and particularly the central carriage includes an indicator to align with the saw cutting position to ensure easy and accurate placement of the clamping system onto the workpiece. The user, then, would align the indicator to the desired position on the pipe to cut prior to tightening the clamping system in position. This aspect is described in greater detail herein.

To cut tubular pipe, a saw affixed to the clamping assembly described herein is turned on and the blade lowered until the blade completely penetrates through the wall of the pipe. The entire saw/clamping assembly is then rotated around the circumference of the pipe or workpiece either manually or with a feed mechanism until complete separation of the pipe workpiece into two pieces is accomplished and the pipe is cut through.

Preferably, the clamping assembly is configured such that one or more of the rollers at the pivoting arms and/or central carriage allow rotation of the clamp/saw in a single direction only in order to control the proper rotation of the assembly around the workpiece relative to the rotating cutting blade.

The present subject matter also provides a quick release female nut at the base and handle assembly that disengages the threaded shaft from the base and handle assembly by pivoting the quick release female nut and removing contact between female threads of the quick release nut and male threads of the threaded shaft. In this fashion, the user can more quickly open or close the clamping system to the pipe or workpiece and adjust the size that the clamp rollers will contact.

Figure 3A:
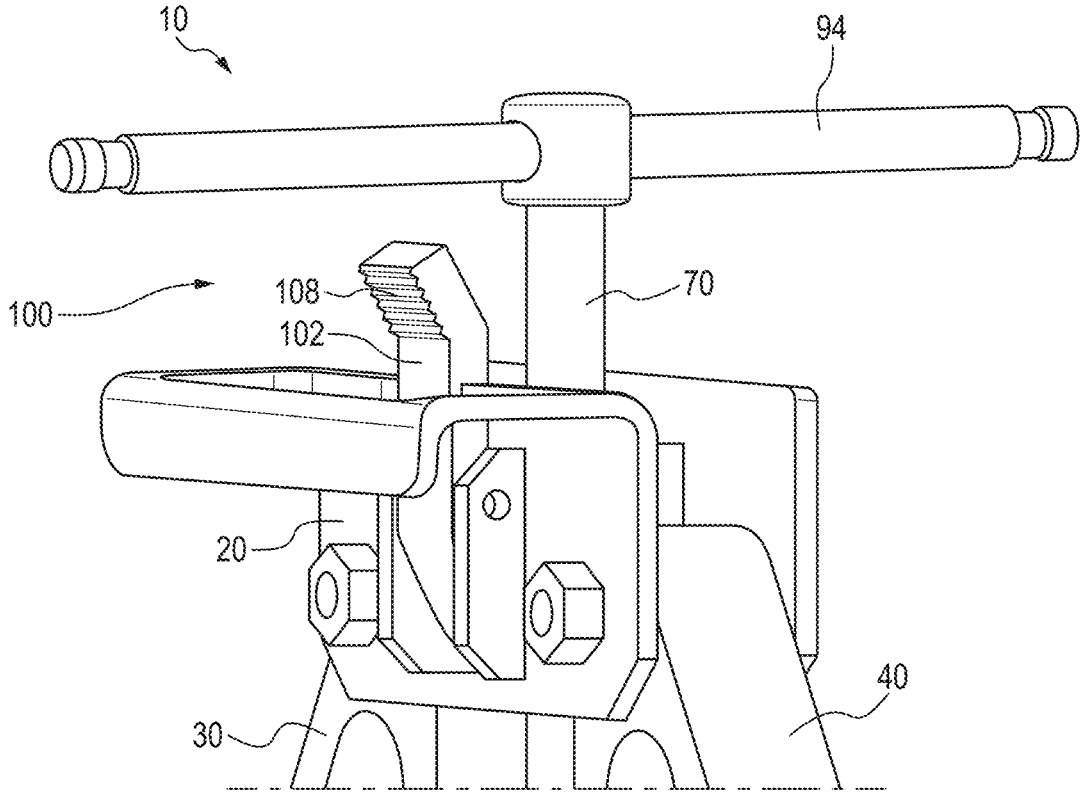
FIGS. 3A and 3B illustrate an embodiment of a quick release provision of the clamping system in accordance with the present subject matter.
Figure 3B:
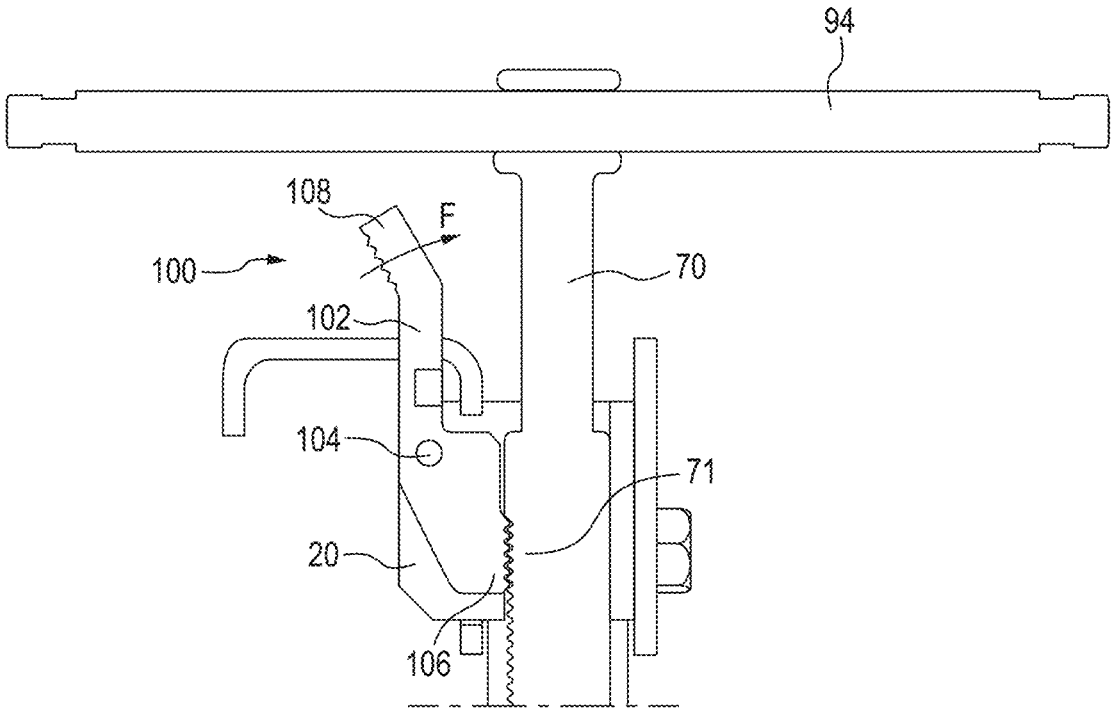

FIGS. 3A and 3B illustrate an embodiment of a quick release nut assembly 100 in accordance with the present subject matter. The assembly 100 comprises a quick release nut 102 pivotally attached to the base 20 via a pin or like member 104. The nut 102 includes a threaded engagement end 106 and an opposite gripping end 108. The threaded shaft 70 defines a receiving region 71 which is sized and shaped to threadedly engage the engagement end 106 of the nut 102 when the nut 102 is pivoted into engagement position such as depicted in FIG. 3B. Typically, male thread(s) of the shaft 70 within the receiving region 71 threadedly engage female threads at the engagement end 106 of the nut 102. Thus, in this version, the previously described threaded region 22 of the base 20 is provided by the threaded engagement end 106. As will be understood with further reference to FIG. 3B, upon positioning the nut 102 to the engagement position as shown, the shaft 70 is axially positioned as desired by axial rotation of the shaft 70 as previously described. In this manner, the clamping system 10 is engaged about a workpiece or pipe. When a user wishes to quickly disengage the clamping system 10 from the workpiece, the user urges the gripping end 108 of the nut 102 in the direction of arrow F, thereby pivoting the nut 102 about the pin 104 and thereby releasing the threaded engagement between the engagement end 106 of the nut 102 and the threads of the shaft 70 along the receiving region 71.

To cut the pipe workpiece, the clamping system is configured to accommodate two unique setups. In one setup, a pipe or workpiece is allowed to rotate such as on support rollers. In another setup, the pipe or workpiece is stationary, for example mounted on a pipe stand or installed in-place. These are described in greater detail herein.

Cutting Tools

A wide array of tools and particularly cutting tools such as powered cutting saws can be used with the clamping systems. Typically, the cutting tools include a rotary cutting blade driven by an electric motor. The cutting tools can be in the form of an integral electrically powered rotary blade saw that is engaged to the clamping system. In other applications, the cutting tools can be in the form of a rotary blade saw that is driven by a separable electrically powered drive. Examples of this latter system include a Model 258 (or 258XL) Power Pipe Cutter and Number 700 Power Drive, available from Ridge Tool under the RIDGID designation. It will be understood that the present subject matter can be used with a wide array of cutting tools and/or saws.

Rotating Pipe Workpiece

Figure 4A:
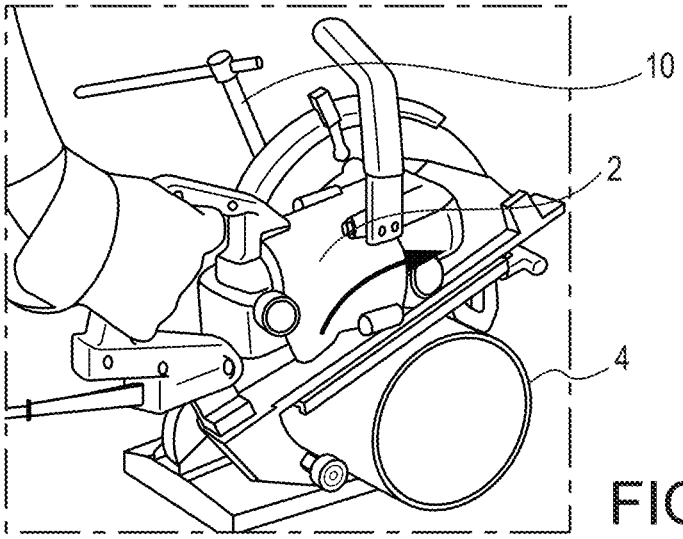
FIGS. 4A-4C illustrate a cutting method for rotating pipe using an embodiment of the clamping system in accordance with the present subject matter.
Figure 4B:
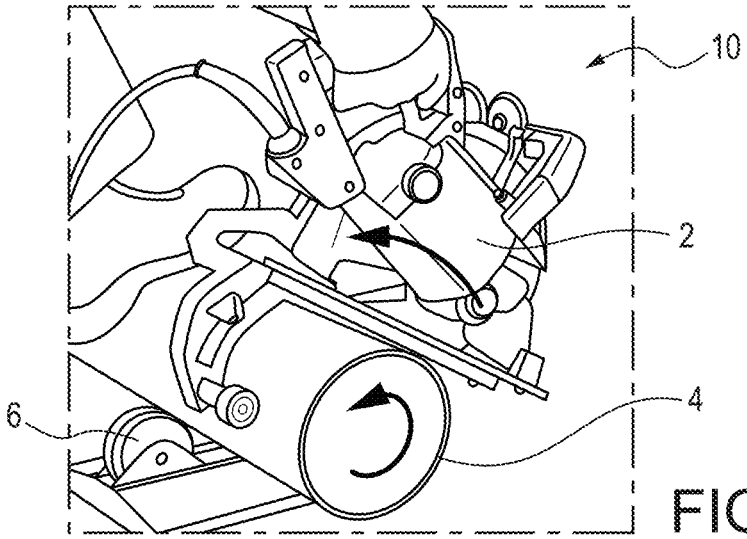
Figure 4C:
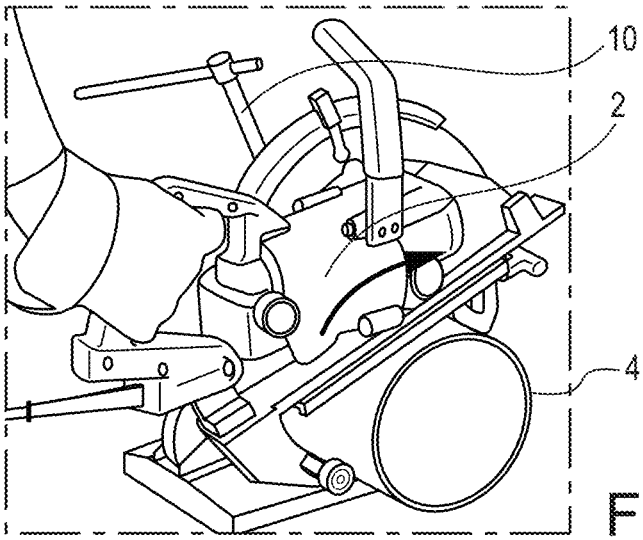

For a rotating pipe workpiece, the pipe or workpiece can be set onto rollers 6 on the ground that allow the pipe to rotate freely as depicted in FIGS. 4A-4C. A saw 2 and/or the clamping system 10 is affixed to the outside diameter of the pipe or workpiece 4 as described herein and positioned such that the cutting blade is aligned with the desired axial position where the separation of the singular pipe workpiece into multiple pieces is desired. When properly set up and the cutting blade sufficiently engaged into the pipe workpiece as shown in FIG. 4A, the tool assembly 2, 10 can then be rotated circumferentially around the pipe or workpiece 4 with the pipe held stationary until the user pushes the saw to their furthest possible reach. Referring to FIG. 4B, then the entire saw and pipe rotated together back toward the user. Then, referring to FIG. 4C, a forward motion is repeated. This action is repeated until the pipe or workpiece is properly cut through at the desired position.

The ground rollers 6 can freely rotate in either direction or be configured to provide rotation of the pipe in a single direction that correlates to the direction of the cutting blade rotation. In the latter, the user would not need to hold the pipe or workpiece stationary during the cutting movements of the clamp/saw tool since the rollers would counteract the pipe rotation.

Stationary Pipe Workpiece

Figure 5:
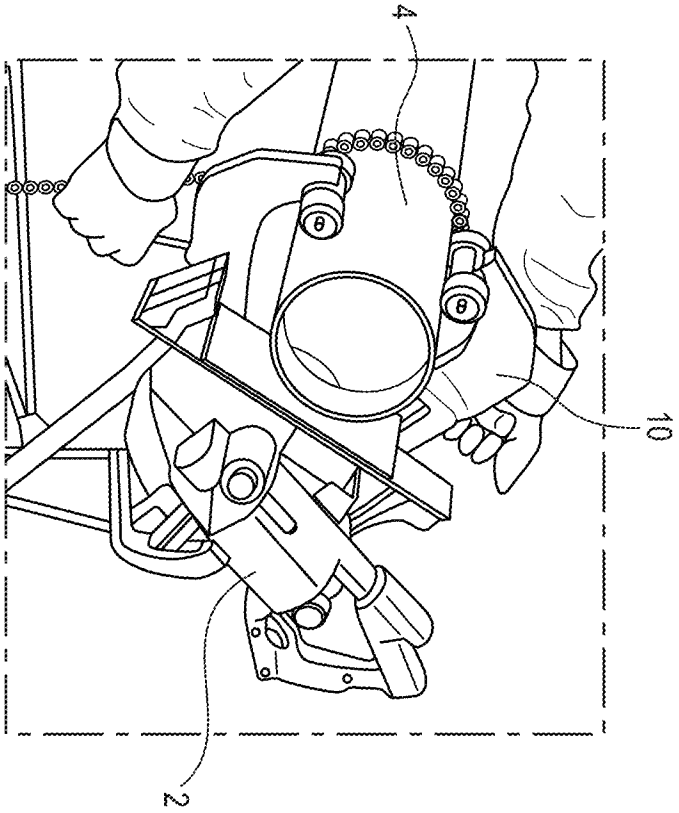
FIG. 5 illustrates a cutting method for a stationary pipe using an embodiment of the clamping system in accordance with the present subject matter.

To allow the cutting of a stationary pipe or workpiece, the clamping assembly is designed such that the user has access to grab points/handles of the assembly at various positions around the assembly and/or workpiece. In this fashion, the user would install the clamp/saw onto the stationary pipe or workpiece as described herein for example held via a vise or clamp, or otherwise fixed in position by mechanical attachment. A representative installation is depicted in FIG. 5. After the blade of the saw 2 is properly plunged through the wall of the pipe 4, the clamp/saw 2, 10 is positioned around the circumference of the pipe until the pipe or workpiece is adequately cut. Throughout this cutting method, the user is positioned on one side of the pipe or workpiece 4 and manipulates the position of the tool assembly 2, 10 through the use of grab points/handles arranged to provide adequate control over the cutting throughout the entire process.

Additional Aspects

The present subject matter also provides a suspension system to better adapt the clamping assembly to variations in the pipe or workpiece. When the clamping assembly is completely tightened to the pipe or workpiece outside diameter, minor surface imperfections or slight ovality in the pipe can increase the difficulty in moving the clamp/saw tool around the circumference of the workpiece. The suspension system is provided by the positioning of one or more springs between the central carriage and the threaded shaft. As the threaded shaft is tightened after all rollers make contact with the pipe or workpiece surface, the spring is deformed and a resulting force, dictated by the spring constant and the distance of compression of the spring, is exhibited between the joint of the threaded shaft and central carriage. Surface variations or profile changes of the pipe or workpiece will be offset by small spring compression or extension changes of the suspension spring. In this manner, the clamping assembly can be easily rotated around the circumference of the pipe or workpiece without loss in clamp joint integrity or becoming too difficult to rotate. This suspension system also allows the user to easily attach the clamping system to the pipe or workpiece with a consistent clamp joint force between the clamp/saw and the pipe through the use of a visual indicator that shows when the preferred suspension spring compression has been experienced. This suspension spring compression position can be configured to occur at a proper clamping force that is adequate for proper cutting completion.

Figure 6:
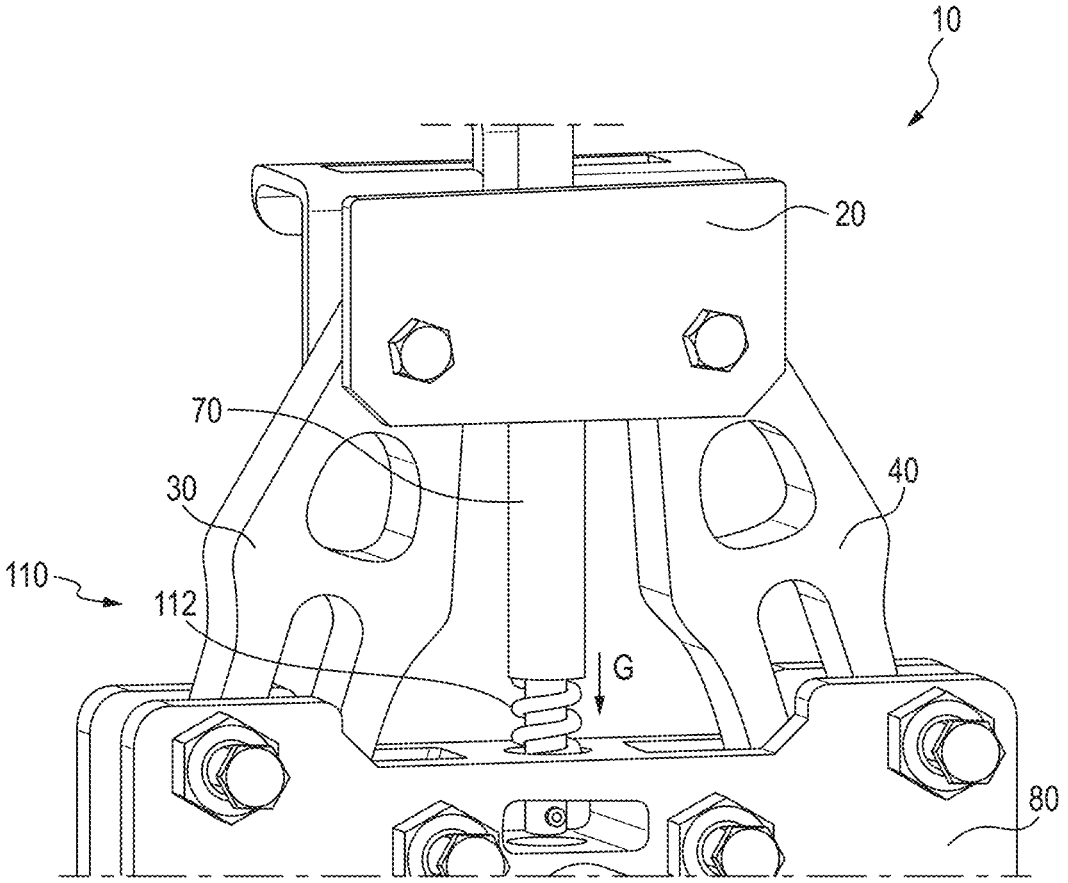
FIG. 6 illustrates a suspension spring used in certain embodiments of the present subject matter.

Referring to FIG. 6, an embodiment of a suspension system 110 is shown incorporated in the clamping system 10. The suspension system includes a spring 112 positioned between the shaft 70 and the central carriage 80. As will be understood, the spring 112 applies a force in the direction of arrow G to the central carriage 80.

The clamping assembly can be additionally configured such that the pivoting arms are spring-biased open so that when the threaded shaft is disengaged from the handle linkage, the arms open without manual effort, or with minimal effort.

Figure 7:
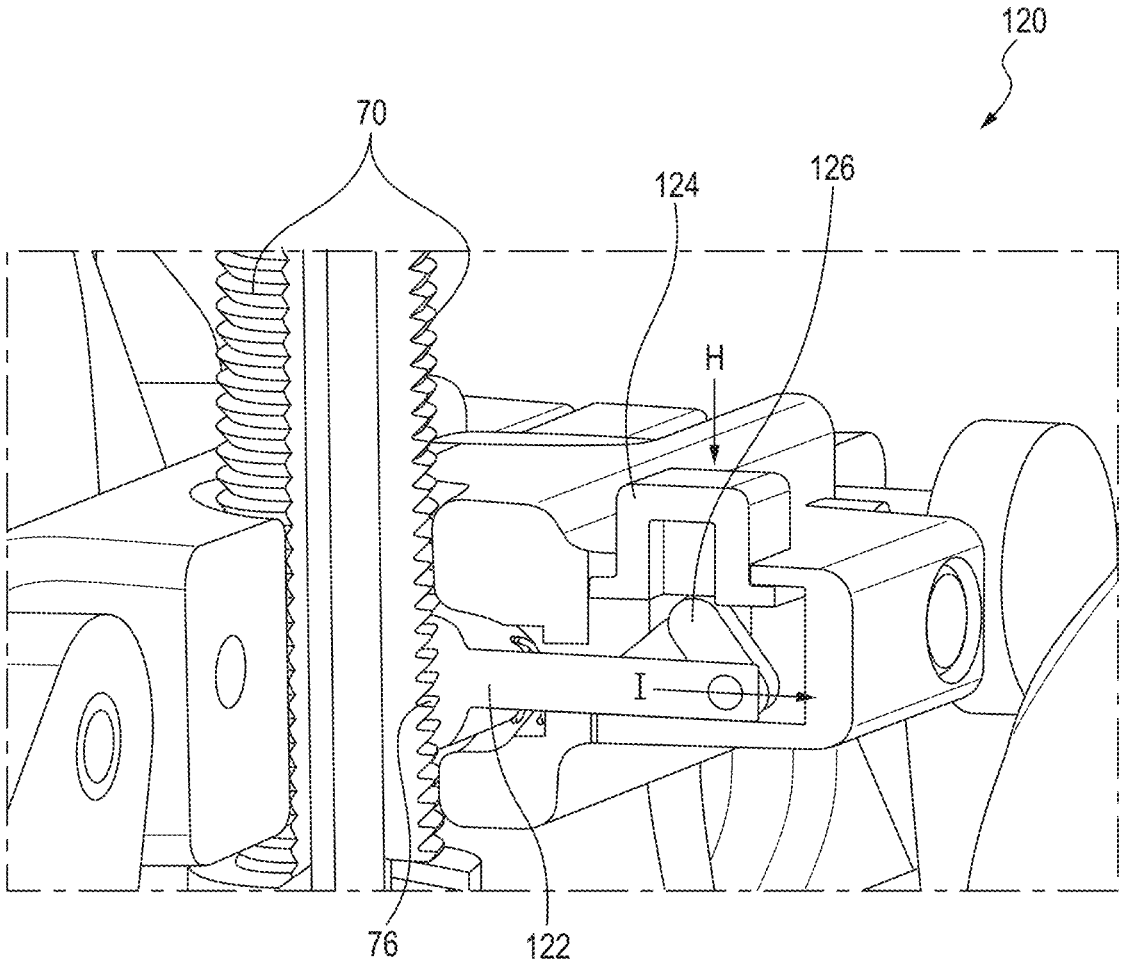
FIG. 7 illustrates another embodiment of a quick release provision used in certain embodiments of the present subject matter.

In addition to the embodiments and features described herein, and particularly the quick release feature for rapid size adjustment, another embodiment of the quick release is shown in FIG. 7. This quick release features a partial nut that engages into the threaded shaft of the clamping system, but is slideably released through the depression of a button by the operator and a linkage system coupling the button to the nut. When the button is depressed, the linkage pulls the partial nut out of engagement. When the button is released by the operator, a spring biases the nut back into contact with the threaded shaft. The partial nut is contained in a housing that features a tapered top surface. This taper, which must be set at an angle steeper than the thread angle, helps to self-energize the nut into the shaft and prevent inadvertent separation between the female threaded nut and the male threaded shaft. The thread profile is optimally designed using buttress thread profile, but can likewise utilize ACME, screw thread, or other helical profiles.

Specifically, FIG. 7 illustrates an embodiment of this quick release assembly 120 incorporated in the clamping system 10. The quick release assembly 120 comprises a partial nut 122 that engages the threaded shaft 70. The partial nut 122 can be slideably released from its threaded engagement with the shaft 70 by depressing a button 124 or other actuator in the direction of arrow H. A linkage system 126 couples the button 124 to the partial nut 122 such that upon depressing the button 124, the linkage system 126 pulls the nut 122 out of engagement with the shaft 70, in the direction of arrow I. Particularly, the partial nut 122 is slideably positionable between an engaged position in which the nut 122 is threadedly engaged with the threaded region 76 of the shaft 70 and a disengaged position in which the partial nut 122 is free from contact with the threaded region 76 of the shaft 70.

Additionally, controlling the amount of force supplied into the clamping system is beneficial to the user to eliminate variation in the tightness of the clamping system onto the pipe, and to ensure that an adequate amount of clamp force is applied to properly hold the assembly in place. Clamp control can be achieved in many ways, but a preferred embodiment limits the force directly applied rather than the torque. This manner eliminates variations due to the friction of the system, and, therefore, is more accurate and consistent for repeatable use. To achieve force control, a stack of Belleville spring washers with known spring rate are positioned between the distal end of the threaded shaft and particularly a threaded collar, and the central carriage. An input handle is coupled to a central shaft of fixed length, and the handle features a post that engages a hole or slot in the threaded collar. As the input handle is rotated clockwise for right-hand thread profiles, tension is applied to the threads of the threaded collar, which compresses the spring washer stack. As the spring washer stack compresses, the threaded collar is similarly translated downward, towards the central carriage. This axial translation of the threaded collar is also relative to the fixed central shaft and handle. The resulting gap between the handle and the threaded collar reduces the post engagement into the threaded collar. At a known amount of threaded collar displacement (correlating to the spring washer deflection to achieve the desired input clamping force), separation of the post from the threaded collar occurs. When this separation happens, no more input force is possible. The handle will continue to rotate without inducing rotation into the threaded collar. Conversely, when the clamping assembly is intended to be loosened, the operator rotates the handle counterclockwise and the tapered post profile allows the post to re-engage with the hole/slot of the threaded collar and continued rotation loosens the system, thereby allowing the spring washer stack to extend and axially translate the threaded collar back upwards toward the handle and away from the central carriage.

Figure 8:
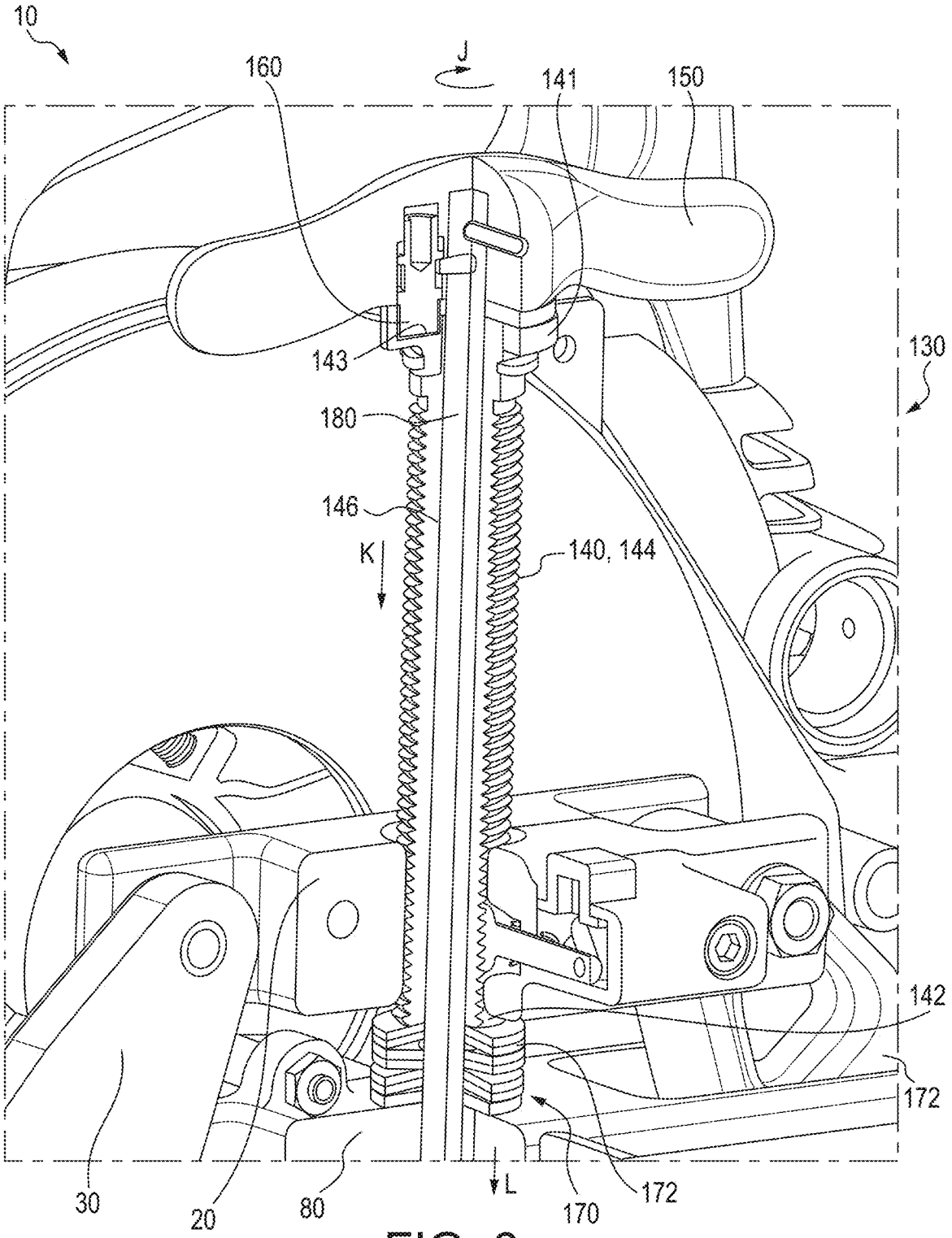
FIG. 8 illustrates a force limit system used in certain embodiments of the present subject matter.

Specifically, FIG. 8 illustrates an embodiment of a force limit system 130 incorporated in the clamping system 10. The force limit system 130 comprises a threaded collar 140, a handle 150, a post 160, a stack 170 of one or more spring washers 172, and a central shaft 180. The collar 140 defines a proximal end 141 and an opposite distal end 142. The collar 140 defines a threaded region 144 along its outer periphery, and a central bore 146 extending along its length. The central shaft 180 is disposed within the central bore 146 of the collar 140. The collar 140 also defines a hole or slot 143 at or near the proximal end 141 adjacent the handle 150. The post 160 is received within the hole or slot 143. The post 160 serves to engage and couple the handle 150 to the proximal end 141 of the threaded collar 140 and also disengage the handle 150 from the proximal end 141 of the threaded collar 140, depending upon the extent of compression of the stack 170 of spring washers 172.

As depicted in FIG. 8, the threaded region 144 of the collar 140 is threadedly engaged with the base 20. Thus, rotation of the handle 150 and central shaft 180 in the direction of arrow J for example, results in axial displacement of the central shaft 180 in the direction of arrow K, and linear displacement of the central carriage 80 in the direction of arrow L. Concurrently, the noted rotation of the shaft 180 in the direction of arrow J results in pivotal displacement of the arms 30, 40 as previously described.

Referring further to FIG. 8, as the handle 150 and the central shaft 180 are rotated in the direction of arrow J, the distal end 142 of the collar 142 is displaced in the direction of arrow K thereby compressing the stack 170 of spring washers 172. The resulting axial translation of the threaded collar 140 causes a gap or space between the handle 150 and the proximal end 141 of the collar 140. This gap thereby reduces the extent of engagement between the post 160 and the hole or slot 143 defined at the proximal end 141 of the collar 140. As will be understood, continued rotation of the handle 150 and central shaft 180 eventually causes disengagement and separation between the post 160 and the proximal end 141 of the collar 140. Thus, as previously described, continued rotation of the handle 150 and central shaft 180 does not cause further displacement of components.

The force limit system 130 can be utilized in the previously described clamping system 10 by providing the noted shaft 70 in the form of the threaded collar 140 with the central shaft 180 extending within the central bore 146 of the collar 140. The stack 170 of spring washers 172 are disposed between the distal end 142 of the collar 140 and the central carriage 80.

In certain embodiments, the clamping assembly also utilizes a brake system that holds a rotating clamping system in position relative to the pipe until the user desires the system to move circumferentially around the pipe surface. In most cases, it is undesirable that the clamping system rotates around the pipe circumference until the cutting saw blade is completely plunged through the pipe wall. Therefore, a spring-biased lever can be employed that contacts the roller or wheel, with or without a flexible interface such as rubber or another polymer, to prevent rotation. The lever can be rotated or otherwise actuated to disengage contact from the wheel when movement is needed. This rotation can be actuated by a mechanism on the saw cutting head that contacts the brake lever as the saw cutting head is plunged into the pipe workpiece, thus eliminating any manual effort by the operator to release the brake. If the user desires to move the clamping assembly around the pipe circumference without the saw cutting head plunged into the pipe, the brake lever can be manually pivoted to release the brake from contacting the wheel. A spring-bias can be configured such that the spring moves over center from the pivot, thereby holding the brake out of contact from the wheel while the operator repositions the clamping assembly as needed.

Figure 9:
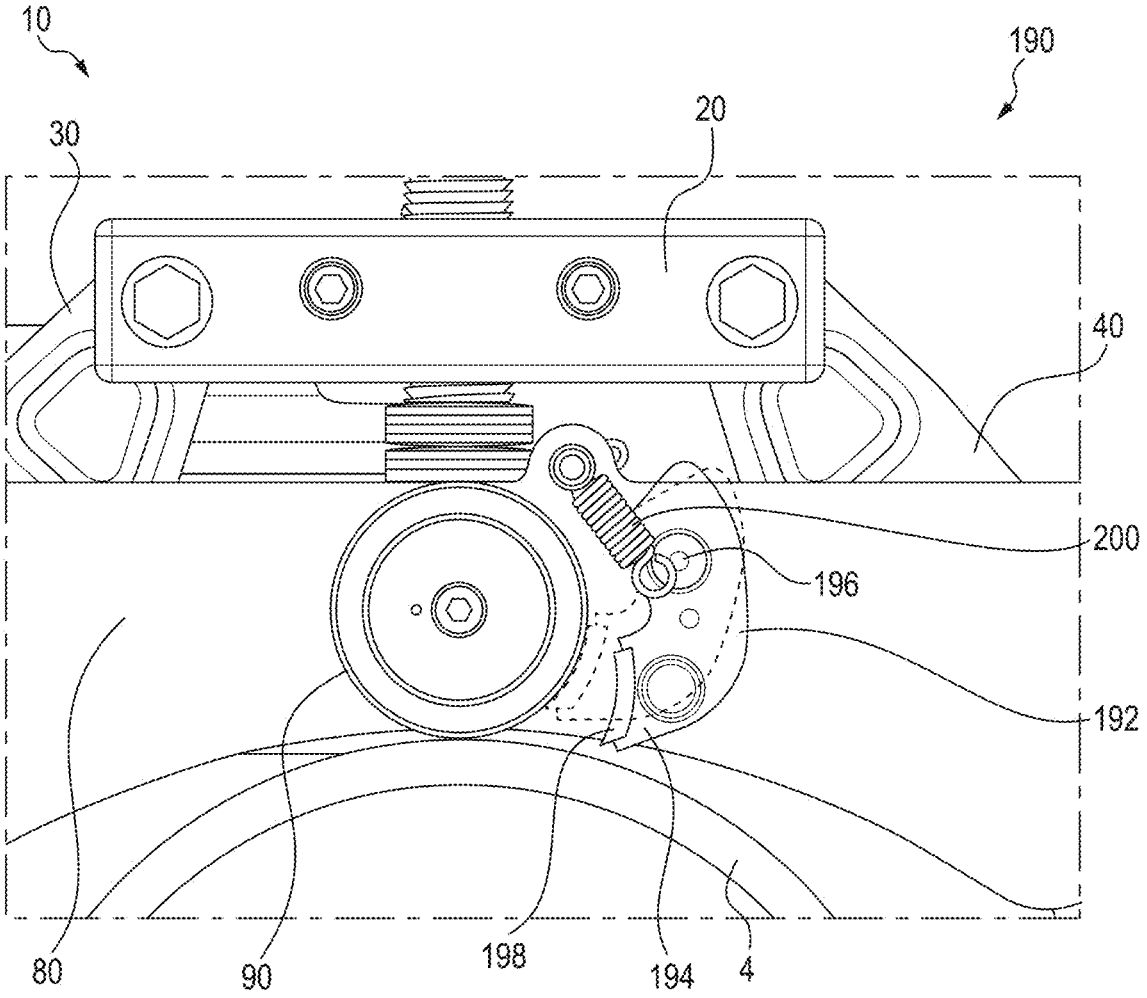
FIG. 9 illustrates a brake system used in certain embodiments of the present subject matter.

FIG. 9 illustrates an embodiment of a brake system 190 used in the clamping system 10. FIG. 9 depicts a central roller 90 engaging a workpiece 4. The central roller 90 is rotatably supported on the central carriage 80. The brake system 190 comprises a lever 192 defining an engagement end 194. The lever 192 is pivotally or moveably secured to the central carriage 80 such as by a retention member 196. The lever 192 defines a face 198 which can include one or more high friction material(s) for contacting the central roller 90. The brake system 190 can also include a spring 200 or other biasing member to urge or bias the face 198 of the lever 192 into contact and/or engagement with the central roller 90. As will be understood by further reference to FIG. 9, the lever 192 is selectively positionable between (i) an engaged position in which the lever 192 contacts the roller 90 and prevents rotation of the roller 90 (shown in dashed lines), and (ii) a disengaged position in which the lever 192 is free from contact with the roller 90.

Figure 10:
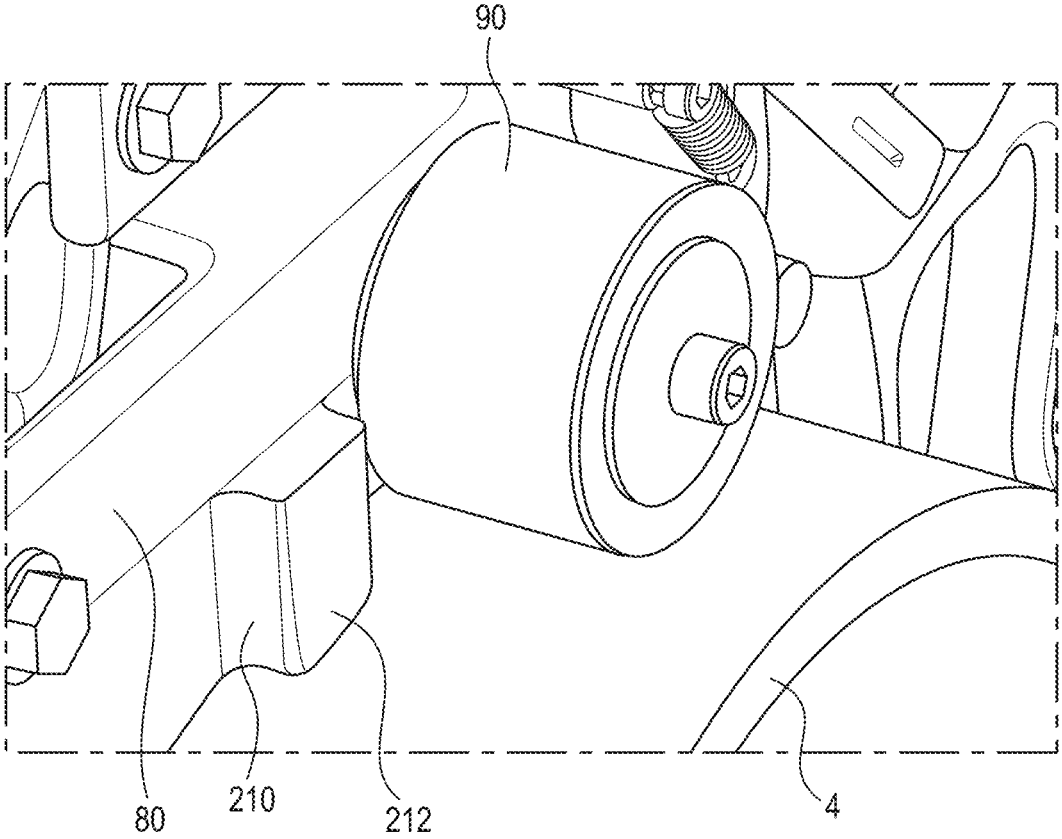
FIG. 10 illustrates a clamp alignment provision used in certain versions of the present subject matter.

A preferred embodiment of the alignment mechanism ensures proper placement of the clamping assembly on the pipe relies on the user to measure a set distance from the intended cut position to known locations on the clamp. FIG. 10 illustrates an embodiment of an indicator or stand-off 210 that defines a face 212 which is co-extensive, or generally so, to a location on a workpiece 4 at which cutting will occur. Thus, the face 212 provides a tangible representation for a user to better identify where cutting on the workpiece will occur. The indicator or stand-off 210 can be provided in a wide array of forms and configurations so long as the noted face 212 is provided for visual reference by a user. Alternatively, a separate gauge or other indicator can be supplied with, and stored on, the tool that corresponds to this set distance. This gauge can then be used by the operator to place the clamping assembly in the correct position relative to the cut position and tighten the clamping assembly in place.

A preferred embodiment of the suspension system for the clamping assembly to compensate for diameter variation or ovality in the pipe profile is provided by the clamp arms. The clamp arm material is selected and arm geometry is configured such that the ends of the arms, where the wheels or rollers are positioned, deflect by a known amount when the proper clamp tightening torque is applied. The amount of deflection designed into the system is determined based on the maximum pipe diameter variation and ovality change and, therefore, compensates for those workpiece variations during use.

In particular versions, the outer surface of the wheels or rollers of the clamping assembly have a knurl pattern or similar feature to improve the grip at the interface between the wheel/roller and the pipe. This knurl pattern could have many various profiles, such as straight knurl, circumferential knurl, herring bone knurl, male diamond, female diamond, left-hand and right-hand.

A preferred embodiment of the clamping assembly also features a support/handle frame. This frame provides a structure around the clamping assembly that allows the assembly, when alone or coupled with the cutting head, to stand when set down, but also provides integral handle positions for the operator to manipulate the tool around the pipe during use. Similarly, this frame provides a type of protective structure to reduce the likelihood of tool damage.

Figure 11:
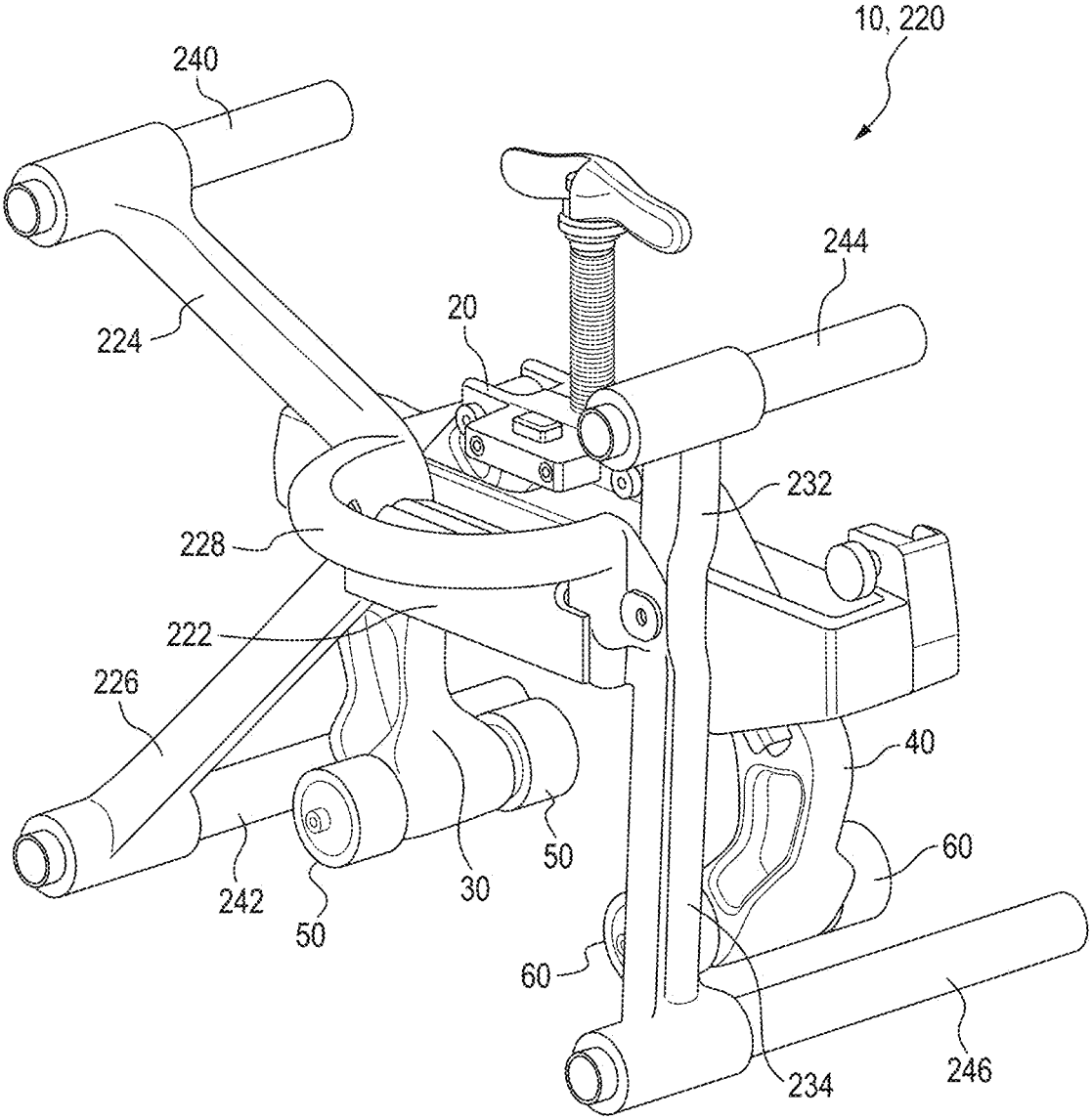
FIG. 11 is a perspective view of a handle/support frame used in certain embodiments of the present subject matter.

FIG. 11 illustrates an embodiment of a frame 220 secured to the clamping assembly 10. The frame 220 comprises a central component 222 and a plurality of outwardly extending members such as a first proximal member 224 extending outward from the central component 222, a first distal member 226 extending outward from the central component 222, a second proximal member 232 extending outward from the central component 222, and a second distal member 234 extending outward from the central component 222. The frame 220 may additionally comprise one or more handle(s) such as a handle 228 generally located adjacent the central component 222. The various members such as 224, 226, 232, and 234, typically extend outward within a plane generally parallel with a cutting plane upon using the clamping system 10 and frame 220 with a saw (not shown). However, it will be understood that the present subject matter is not limited to such a configuration and includes a wide array of different configurations. The frame 220 optionally additionally comprises one or more grab member(s) affixed or formed with any of the members 224, 226, 232, and/or 234. For example, with further reference to FIG. 11, the frame 220 comprises a first grab member 240, a second grab member 242, a third grab member 244, and a fourth grab member 246. In many versions of the frame 220, one or all of the grab members 240, 242, 244, and/or 246 extend in direction transverse to a cutting plane and/or one or more of the proximal and the distal members. And, typically each of the grab members 240, 242, 244, and 246 have a length greater than the maximum width of the clamping system 10. One or more of the distal members such as distal members 226 and/or 234, and/or one or more of the grab members extending therefrom such as grab members 242 and/or 246 may also serve as ground-contacting members or feet or if singular, as a foot.

In certain versions, the clamping assembly of FIGS. 1 and 2 can be configured such that a single shaft of wheels contacts the pipe at the central carriage, as shown, or a plurality of shafts contacts the pipe.

A significant advantage of the clamping assembly of the present subject matter is its efficiency. With the ease of setup and use, as well as the accurateness of the cutting action, the clamping assembly allows cutting of pipe in significantly less time than any other assemblies and/or processes currently available. Secondary clean-up of the cut edge prior to further manipulation of the pipe is not required with the present subject matter compared to existing assemblies and methods, again reducing the process time required. In addition, the pipe size range that the clamping assemblies of the present subject matter cover, provides greater flexibility of tool use and faster use in completing jobs involving multiple pipe sizes. Some jobsites require a dedicated fire watch where an open flame is used, but the present subject matter eliminates the need for a torch and frees the time commitment of that individual so their productivity can be applied elsewhere in the manufacturing process.

The suspension system allows better alignment of the cutting tool to the workpiece and eases use if ovality of the workpiece is encountered.

The suspension system described herein can alternatively be provided by spring-supporting the rollers to the central carriage or the rollers to the pivoting arms, rather than spring-supporting the threaded shaft to the central carriage. In this fashion, the system can be tightened as desired to the pipe or workpiece but allows for variations in surface profile and reduces the user's ability to overtighten the clamp onto the workpiece. In another embodiment, the compliance of the system can also be accomplished by making the support arms themselves compliant.

Many other benefits will no doubt become apparent from future application and development of this technology.

All patents, applications, standards, and articles noted herein are hereby incorporated by reference in their entirety.

The present subject matter includes all operable combinations of features and aspects described herein. Thus, for example if one feature is described in association with an embodiment and another feature is described in association with another embodiment, it will be understood that the present subject matter includes embodiments having a combination of these features.

As described hereinabove, the present subject matter solves many problems associated with previous strategies, systems and/or devices. However, it will be appreciated that various changes in the details, materials and arrangements of components, which have been herein described and illustrated in order to explain the nature of the present subject matter, may be made by those skilled in the art without departing from the principle and scope of the claimed subject matter, as expressed in the appended claims.

What is claimed is:

1. A clamping system (10) comprising:

a base (20) defining a threaded member (22);

a pair of arms (30, 40) pivotally supported by the base (20), each arm (30, 40) defining a proximal end (32, 42) and an opposite distal end (34, 44);

a shaft (70) threadedly engaged with the threaded member (22) of the base (20), the shaft (70) defining a proximal end (72) and an opposite distal end (74);

a central carriage (80) rotatably affixed to the distal end (74) of the shaft (70) and slideably retained to the pair of arms (30, 40);

wherein rotation of the shaft (70) relative to the base (20) results in (i) axial displacement of the shaft (70) and linear displacement of the central carriage (80), (ii) pivotal displacement of the pair of arms (30, 40);

a force limit system (130), wherein the shaft (70) is in the form of a threaded collar (140), and wherein the collar (140) defines a proximal end (141) and an opposite distal end (142), an outer periphery threaded region (144) extending at least partially between the proximal end (141) and the distal end (142), and a central bore (146) extending between the proximal end (141) and the distal end (142), wherein the force limit system includes:

a central shaft (180) extending through the central bore (146) of the threaded collar (140);

a handle (150) including a post (160) engageable with the proximal end (141) of the threaded collar (140); and one or more springs (112) disposed between the distal end (142) of the threaded collar (140) and the central carriage (80).

2. The clamping system (10) of claim 1 wherein each arm (30, 40) also defines a guide slot (46) extending at least partially between the proximal end (32, 42) and the distal end (34, 44) of each said arm (30, 40), the clamping system (10) further comprising:

a first locating pin (82) extending from the central carriage (80) through the guide slot (46) of a first arm (30 or 40) of the pair of arms (30, 40) and a second locating pin (84) extending from the central carriage (80) through the guide slot (46) of a second arm (40 or 30) of the pair of arms (30, 40) to thereby movably retain the central carriage (80) to the pair of arms (30, 40).

3. The clamping system (10) of claim 1 wherein the central carriage (80) includes one or more rollers (90) rotatably secured to the central carriage (80).

4. The clamping system (10) of claim 1 further comprising:

a quick release provision (100) including a nut (102) pivotally engaged with the base (20), the nut (102) defining a threaded engagement end (106), wherein the shaft (70) is threadedly engaged with the threaded member (22) of the base (20) by threaded engagement with the engagement end (106) of the nut (102).

5. The clamping system (10) of claim 1 further comprising:

a suspension system (110) including one or more springs (116) positioned between the shaft (70) and the central carriage (80).

6. The clamping system (10) of claim 1 further comprising an indicator (210) extending from the central carriage (80), the indicator (210) defining a face (212) for visual reference to align the clamp in a position desired by a user.

7. A framed support system comprising the clamping system (10) of claim 1 and:

a frame (220) secured to the clamping system (10), wherein the frame (220) includes a central component (222), and a plurality of outwardly extending members.

8. The framed support system of claim 7 wherein the plurality of outwardly extending members include:

a first proximal member (224) extending outward from the central component (222);

a first distal member (226) extending outward from the central component (222);

a second proximal member (232) extending outward from the central component (222); and a second distal member (234) extending outwardly from the central component (222).

9. The framed support system of claim 8 wherein the frame (222) further includes: at least one grab member (240, 242, 244 or 246) affixed to the proximal or distal members (224, 226, 232 or 234), the at least one grab member (240, 242, 244 or 246) extending transversely therefrom.

10. The framed support system of claim 8 wherein at least one of the first distal member (226) and the second distal member (234) serves as a ground-contacting member.

11. The clamping system of claim 1, wherein a first spaced-apart pair of rollers (50) of one or more rollers (50, 60) are rotatably supported about a first longitudinal axis by a first arm (30) of the pair of arms (30, 40), wherein a second spaced-apart pair of rollers (60) of the one or more rollers (50, 60) are rotatably supported about a second longitudinal axis by a second arm (30) of the pair of arms (30, 40), and wherein the first and second axes are parallel, whereby a pipe (4) of predetermined length when contacted by the first and second spaced-apart pairs of rollers (50, 60) aligns with the first and second axes.

12. A clamping system (10) comprising:

a base (20) defining a threaded member (22);

a pair of arms (30, 40) pivotally supported by the base (20), each arm (30, 40) defining a proximal end (32, 42), an opposite distal end (34, 44), and wherein each arm (30, 40) of the pair arms includes one or more rollers (50, 60);

a shaft (70) threadedly engaged with the threaded member (22) of the base (20), the shaft (70) defining a proximal end (72) and an opposite distal end (74);

a central carriage (80) rotatably affixed to the distal end (74) of the shaft (70) and slideably retained to the pair of arms (30, 40);

wherein rotation of the shaft (70) relative to the base (20) results in (i) axial displacement of the shaft (70) and linear displacement of the central carriage (80), (ii) pivotal displacement of the pair of arms (30, 40);

a brake system (190) including a lever (192) moveably attached to the central carriage (80) and selectively positionable between (i) an engaged position in which the lever (192) contacts one or more rollers (90) secured to the central carriage (80) and prevents rotation of the rollers (90), and (ii) a disengaged position in which the lever (192) is free from contact with the one or more rollers (90) secured to the central carriage (80) thereby enabling rotation of the rollers (90).

13. The clamping system (10) of claim 12 wherein the brake system (190) further includes a biasing member (200) to urge the lever (192) toward the engaged position.

14. The clamping system (10) of claim 12 wherein each arm (30, 40) also defines a guide slot (46) extending at least partially between the proximal end (32, 42) and the distal end (34, 44) of each said arm (30, 40), the clamping system (10) further comprising:

a first locating pin (82) extending from the central carriage (80) through the guide slot (46) of a first arm (30 or 40) of the pair of arms (30, 40) and a second locating pin (84) extending from the central carriage (80) through the guide slot (46) of a second arm (40 or 30) of the pair of arms (30, 40) to thereby movably retain the central carriage (80) to the pair of arms (30, 40).

15. The clamping system (10) of claim 12 wherein the central carriage (80) includes one or more rollers (90) rotatably secured to the central carriage (80).

16. The clamping system (10) of claim 12 further comprising:

a quick release provision (100) including a nut (102) pivotally engaged with the base (20), the nut (102) defining a threaded engagement end (106), wherein the shaft (70) is threadedly engaged with the threaded member (22) of the base (20) by threaded engagement with the engagement end (106) of the nut (102).

17. The clamping system (10) of claim 12 further comprising:

a suspension system (110) including one or more springs (116) positioned between the shaft (70) and the central carriage (80).

18. The clamping system (10) of claim 12 further comprising an indicator (210) extending from the central carriage (80), the indicator (210) defining a face (212) for visual reference to align the clamp in a position desired by a user.

19. A framed support system comprising the clamping system (10) of claim 12 and:

a frame (220) secured to the clamping system (10), wherein the frame (220) includes a central component (222), and a plurality of outwardly extending members.

20. The framed support system of claim 19 wherein the plurality of outwardly extending members include:

a first proximal member (224) extending outward from the central component (222);

a first distal member (226) extending outward from the central component (222);

a second proximal member (232) extending outward from the central component (222); and a second distal member (234) extending outwardly from the central component (222).

21. The framed support system of claim 20 wherein the frame (222) further includes:

at least one grab member (240, 242, 244 or 246) affixed to the proximal or distal members (224, 226, 232 or 234), the at least one grab member (240, 242, 244 or 246) extending transversely therefrom.

22. The framed support system of claim 20 wherein at least one of the first distal member (226) and the second distal member (234) serves as a ground-contacting member.

23. The clamping system of claim 12, wherein a first spaced-apart pair of rollers (50) of the one or more rollers (50, 60) are rotatably supported about a first longitudinal axis by a first arm (30) of the pair of arms (30, 40), wherein a second spaced-apart pair of rollers (60) of the one or more rollers (50, 60) are rotatably supported about a second longitudinal axis by a second arm (30) of the pair of arms (30, 40), and wherein the first and second axes are parallel, whereby a pipe (4) of predetermined length when contacted by the first and second spaced-apart pairs of rollers (50, 60) aligns with the first and second axes.

* * * * *